US009457381B2

(12) United States Patent
Gordon et al.

(10) Patent No.: US 9,457,381 B2
(45) Date of Patent: Oct. 4, 2016

(54) VIBRATING SCREEN

(71) Applicant: FLSmidth A/S, Valby (DK)

(72) Inventors: Christopher Gordon, Yeronga (AU); Gordon Ong, Seventeen Mile Rocks (AU)

(73) Assignee: FLSmidth A/s (DK)

( * ) Notice: Subject to any disclaimer, the term of this patent is extended or adjusted under 35 U.S.C. 154(b) by 0 days.

(21) Appl. No.: 14/787,413

(22) PCT Filed: Apr. 30, 2013

(86) PCT No.: PCT/IB2013/053422

§ 371 (c)(1),
(2) Date: Oct. 27, 2015

(87) PCT Pub. No.: WO2014/177910

PCT Pub. Date: Nov. 6, 2014

(65) Prior Publication Data

US 2016/0136691 A1 May 19, 2016

(51) Int. Cl.
*B07B 1/28* (2006.01)
*B07B 1/46* (2006.01)

(52) U.S. Cl.
CPC .. *B07B 1/46* (2013.01); *B07B 1/28* (2013.01)

(58) Field of Classification Search
CPC ..... B07B 1/28; B07B 1/40; B07B 1/42; B07B 1/46
USPC ..... 209/319, 405
See application file for complete search history.

(56) References Cited

U.S. PATENT DOCUMENTS 1,645,613 A * 10/1927 Mitchell ..... B07B 1/48 209/315
2,208,596 A * 7/1940 Parks ..... B07B 1/286 209/315
3,003,635 A * 10/1961 Wood ..... B07B 1/46 209/365.3
3,089,582 A * 5/1963 Musschoot ..... B65G 27/18 198/761
3,442,381 A * 5/1969 Johnson ..... B06B 1/166 198/500
4,840,728 A * 6/1989 Connolly ..... B07B 1/46 209/397
4,928,551 A * 5/1990 Connelly ..... B06B 1/166 384/473
5,112,475 A 5/1992 Henry, Jr.
5,265,730 A * 11/1993 Norris ..... B07B 1/42 198/770
5,868,259 A * 2/1999 Bielagus ..... B07B 1/12 209/674
6,029,823 A * 2/2000 Young ..... B07B 1/42 209/325
6,580,189 B2 * 6/2003 Mooney ..... B06B 1/162 184/11.2
6,830,155 B2 * 12/2004 Trench ..... B07B 1/284 209/274
6,889,820 B2 * 5/2005 Rubie ..... B06B 1/166 198/770
7,114,620 B2 * 10/2006 Anibas ..... B07B 1/343 209/319
7,331,469 B2 * 2/2008 Padalino ..... B01D 33/0376 209/404
7,770,737 B2 * 8/2010 Fennekotter ..... B07B 1/46 209/404
9,199,279 B2 * 12/2015 Wojciechowski ..... B07B 1/48

(Continued)

FOREIGN PATENT DOCUMENTS

WO 0211908 A1 2/2002

*Primary Examiner* — Joseph C Rodriguez
(74) *Attorney, Agent, or Firm* — Matthew R. Weaver; Daniel DeJoseph; Jeffrey A. Sharp

(57) ABSTRACT

Disclosed herein are embodiments of a vibrating screen (10) for separation of materials such as ores in mining, quarrying, and mineral processing. The vibrating screen (10) herein disclosed may include a chassis (100) with two side walls (102) with a plurality of support members (104) therebetween and a screen mounting system that receives screen panels (120). At least one of the side walls (102) may have a recess (132) that receives a protrusion (160) of a mounting plate (114) of a vibrator (126).

3 Claims, 6 Drawing Sheets

(56) References Cited

U.S. PATENT DOCUMENTS

2002/0195377 A1* 12/2002 Trench ..... B07B 1/284
209/365.1
2011/0114542 A1* 5/2011 Carr ..... B07B 1/42
209/235
2013/0220892 A1* 8/2013 Wojciechowski ..... B07B 1/30
209/3.1
2014/0097127 A1* 4/2014 Aughey ..... B07B 1/28
209/365.1
2014/0269150 A1* 9/2014 Miller ..... B06B 1/16
366/114
2015/0096944 A1* 4/2015 Krush ..... B07B 1/40
210/780
2016/0074908 A1* 3/2016 Gordon ..... B07B 1/46
209/233

* cited by examiner

VIBRATING SCREEN

FIELD OF THE INVENTION

The invention relates to a vibrating screen. In particular, although not exclusively, the invention relates to a vibrating screen for separation of materials such as ores in mining, quarrying, and mineral processing.

BACKGROUND TO THE INVENTION

Vibrating screens are typically used in the mining, quarrying, and mineral processing industries to separate materials, such as coal, by size. A vibrating screen typically has a chassis with screen panels. The chassis is typically rigid with various support members to ensure structural integrity. The chassis is mounted on springs, or the like, and has vibrators which cause the chassis, and therefore the screen panels, to vibrate. The screen panels have apertures which allow smaller sized material to pass through. In use, the chassis vibrates and material is passed over the screen panels and smaller material is separated from larger material as it passes through the apertures in the screen panels.

The vibratory forces are relatively large and the vibrating screen therefore needs to be built to withstand significant forces, particularly should any components achieve resonance. Typically the chassis of vibrating screens are engineered to be sturdy by using heavy duty components and adding support members and reinforcing to the chassis which adds costs, complexity, and weight to the vibrating screen.

A pair of vibrators are normally connected to sides walls of the chassis via a vibrator support beam. This vibrator support beam is particularly expensive as it is fabricated to exacting standards. This increases costs, complexity, and weight further.

Additionally, the vibratory forces from the vibrators have to be transferred to the chassis and then to the screen panels. In achieving this transfer, regions of weakness can occur in critical components of the chassis.

It will be clearly understood that any reference herein to background material or information, or to a prior publication, does not constitute an admission that any material, information or publication forms part of the common general knowledge in the art, or is otherwise admissible prior art, whether in Australia or in any other country.

OBJECT OF THE INVENTION

It is an object of the invention to overcome or at least alleviate one or more of the above problems and/or provide the consumer with a useful or commercial choice.

Other preferred objects of the present invention will become apparent from the following description.

DISCLOSURE OF THE INVENTION

In one form, although it need not be the only or indeed the broadest form, the invention resides in a vibrating screen comprising:

- a chassis including two side walls with a plurality of support members therebetween and a screen mounting system that receives screen panels; and
- at least one vibrator that generates vibrations;
- wherein at least one side wall has a recess that receives a protrusion of a mounting plate of the vibrator.

Preferably the recess has tapered sides, even more preferably the sides are tapered inward toward an opening of the recess. An end portion of the recess between the sides and opposite the opening is preferably curved. The recess is preferably generally scalloped in shape. The protrusion of the mounting plate preferably corresponds to the recess such that they interlock. The protrusion of the mounting plate preferably has protrusion reinforcing members. The protrusion reinforcing members preferably extend substantially radially with respect to the curved end of the protrusion. In a preferred form, three protrusion reinforcing members are provided.

The mounting plate preferably has a substantially planar skirt that extends from at least a portion of the protrusion. Preferably the mounting plate is affixed to a portion of the chassis. Preferably the skirt of the mounting plate abuts a substantially planar surface of the side walls and is affixed thereto. In a preferred form the skirt of the mounting plate is bolted to at least the side wall of the chassis.

The mounting plate preferably has reinforcing ribs and/or reinforcing members. The reinforcing ribs preferably extend along at least a portion of the skirt and the reinforcing members preferably extend along at least a portion of the protrusion.

The mounting plate preferably has a vibrator mounting portion. The vibrator mounting portion preferably includes a substantially planar mounting surface. The substantially planar mounting surface is preferably substantially perpendicular to a plane of the skirt and/or protrusion of the mounting plate. Preferably the reinforcing ribs engage with both the skirt and the vibrator mounting portion. A vibrator reinforcing beam is preferably mounted between skirt portions on each side wall. Preferably the vibrator reinforcing beam has flanged ends that are affixed to the skirt portions with fasteners.

Preferably the side walls have at least one side reinforcing member extending from the recess. Preferably a plurality of side reinforcing members are provided that extend along the side wall away from the recess. In a preferred form, four side reinforcing members are provided on each side wall, each extending at a different angle. At least two side reinforcing members preferably extend across the side wall. At least two side reinforcing members preferably extend along upper side edges of each side wall. Preferably at least a portion of the reinforcing ribs and/or the reinforcing members of the mounting plate are aligned, or intersect and/or overlap, with at least a portion of the side reinforcing members.

The at least one vibrator is preferably an exciter. Preferably two exciters are provided, one adjacent each side wall. In a preferred form the exciters are eccentric mass exciters. The exciters are preferably mechanically connected to at least one drive assembly.

The vibrating screen preferably further includes springs and spring mounts. The spring mounts preferably form the interface between the springs and the chassis. The spring mounts are preferably affixed to the chassis, even more preferably to the side walls of the chassis. Preferably the side walls of the chassis have spring mounting regions. The spring mounting regions of the side walls preferably include at least one spring mount projection. Preferably the spring mounting regions comprise a plurality of parallel spring mount projections.

The spring mounts preferably comprise a foot and a wedge. The foot preferably connects to the spring mounting regions of the side walls of the chassis and the wedge connects to the foot. The foot preferably comprises at least one fin extending perpendicularly from a base portion.

Preferably the foot comprises a plurality of parallel fins that are affixed to the plurality of parallel spring mount projections. The base portion of the foot is preferably affixed to the wedge.

The wedge preferably has an upper surface and a lower surface. Preferably the upper surface and lower surface we substantially planar. Preferably at least a portion of the upper surface, even more preferably the entire upper surface, is inclined relative to the lower surface. Preferably the upper surface and lower surface of the wedge are separated by a web. The upper surface of the wedge preferably engages with the foot and the lower surface of the wedge preferably engages with the springs.

In a preferred form, the vibrating screen has four spring mounting regions, each affixed to a foot. The four feet affixed to the four spring mounting regions are preferably identical. All four feet are preferably affixed to a respective wedge. Preferably a front pair of feet is affixed to a front wedge and a rear pair of feet is affixed to a rear wedge which has a different incline between the upper surface and lower surface to the front wedge. Preferably the upper surface of the rear wedges is at a greater incline than the upper surface of the front wedges.

Preferably the upper surface of the front wedges is inclined between 0 and 10°, more preferably between 3 and 7°, and in a preferred form approximately 5°, relative to the lower surface. Preferably the upper surface of the rear wedges is inclined between 20 and 30°, more preferably between 23 and 27°, and in a preferred form approximately 25°, relative to the lower surface. Preferably the angle of incline of the upper surface of the wedges is substantially the same as an angle of incline of adjacent screen panels.

Preferably the vibrating screen has an inlet end and an outlet end. Preferably the inlet end is inclined relative to the outlet end. The inlet end preferably has an inlet region configured to receive material. Preferably at least a portion of the inlet region has blind screen panels. Preferably the blind screen panels are made of a highly wear resistant material.

The screen mounting system is preferably a deck support and preferably provides releasable mounting of screen panels. Preferably the screen mounting system comprises a modular screen system allowing individual panels to be removed and replaced. Preferably the screen mounting system comprises one or more stringers mounted to the support members. Preferably the stringers have a longitudinal axis that is perpendicular to the longitudinal axis of the support members. Preferably each support member comprises a square hollow section (SHS) or rectangular hollow section (RHS) with flanged portions on either end. Preferably the flanged portions are affixed to the side walls of the chassis.

In another form, the invention resides in a vibrating screen comprising:

- a chassis including two side walls with a plurality of support members therebetween and a screen mounting system that receives screen panels;
- at least one vibrator that generates vibrations;
- a plurality of spring mounts affixed to the chassis, the spring mounts having a foot and a wedge with an upper surface and a lower surface; and
- a plurality of springs that engage with the plurality of spring mounts;
- wherein the foot of each spring mount is identical, and wherein at least one wedge has the upper surface at an incline relative to the lower surface.

Further features of the present invention will become apparent from the following detailed description.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, wherein.

DETAILED DESCRIPTION OF THE INVENTION

Figure 1:
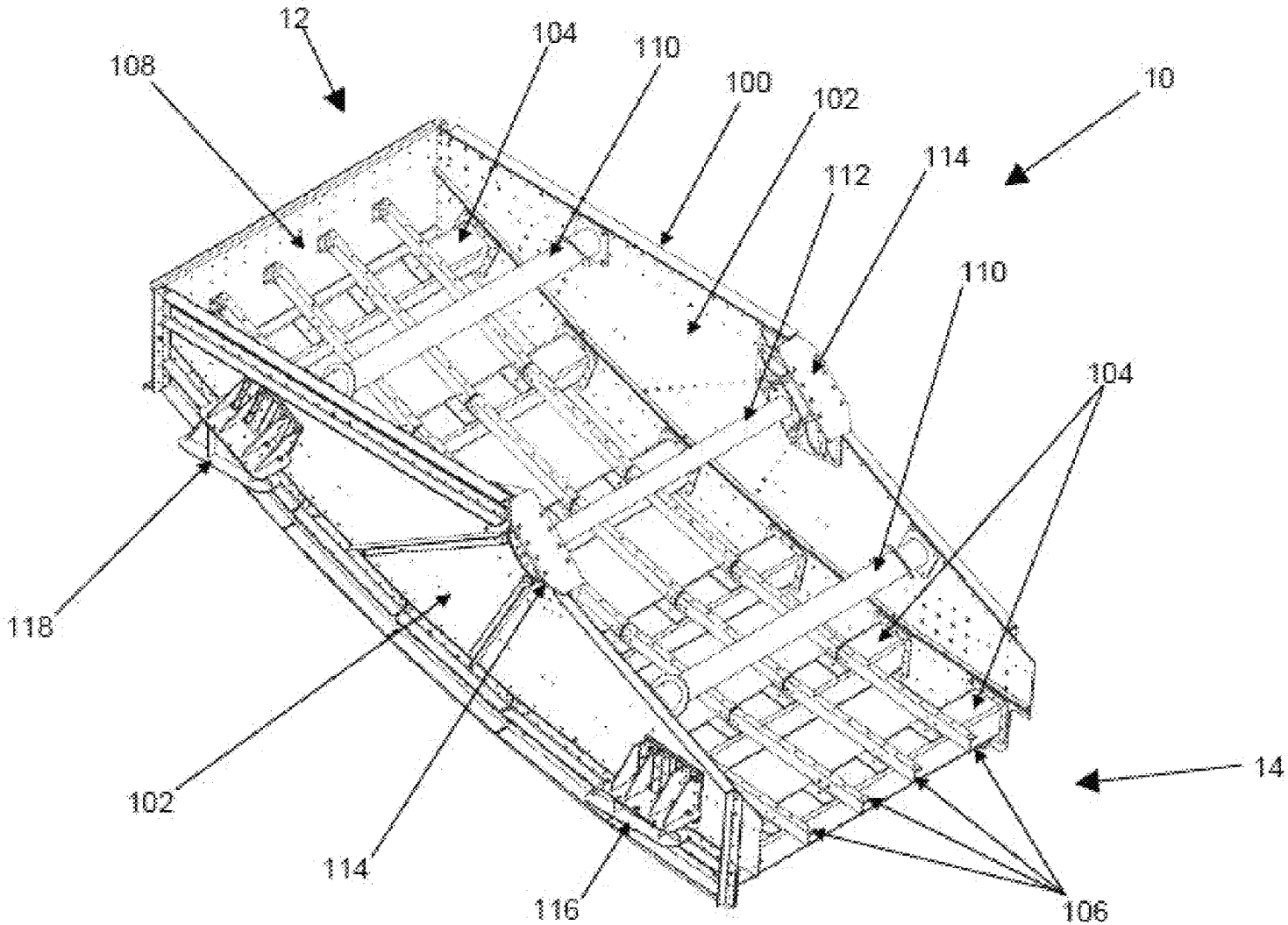
FIG. 1 is a perspective view of a portion of a vibrating screen according to an embodiment of the invention.

FIG. 1 illustrates a majority portion of a vibrating screen 10 having a chassis 100 with two opposed side walls 102, support members in the form of square hollow sections (SHS) crossbeams 104 with a screen mounting system including a plurality of parallel stringers 106 mounted to the crossbeams 104. The vibrating screen 10 has an inlet end 12 and an outlet end 14. The inlet end receives material to be processed and the outlet end outputs processed material. A backing plate 108 is provided between the side walls at the inlet end 12. The stringers 106 extend from the backing plate 108 to the outlet end 14.

The vibrating screen 10 has two lifting beams 110 which can be used to lift and manoeuvre the vibrating screen, typically with a crane (not shown). A vibrator reinforcing beam 112 is mounted between the side walls 102. Specifically, the vibrator reinforcing beam 112 has flanged ends which are mounted between two mounting plates 114 affixed to the side walls 102. Affixed to an outer surface of each side wall 102 is a front spring mount 116 and a rear spring mount 118.

Figure 2:
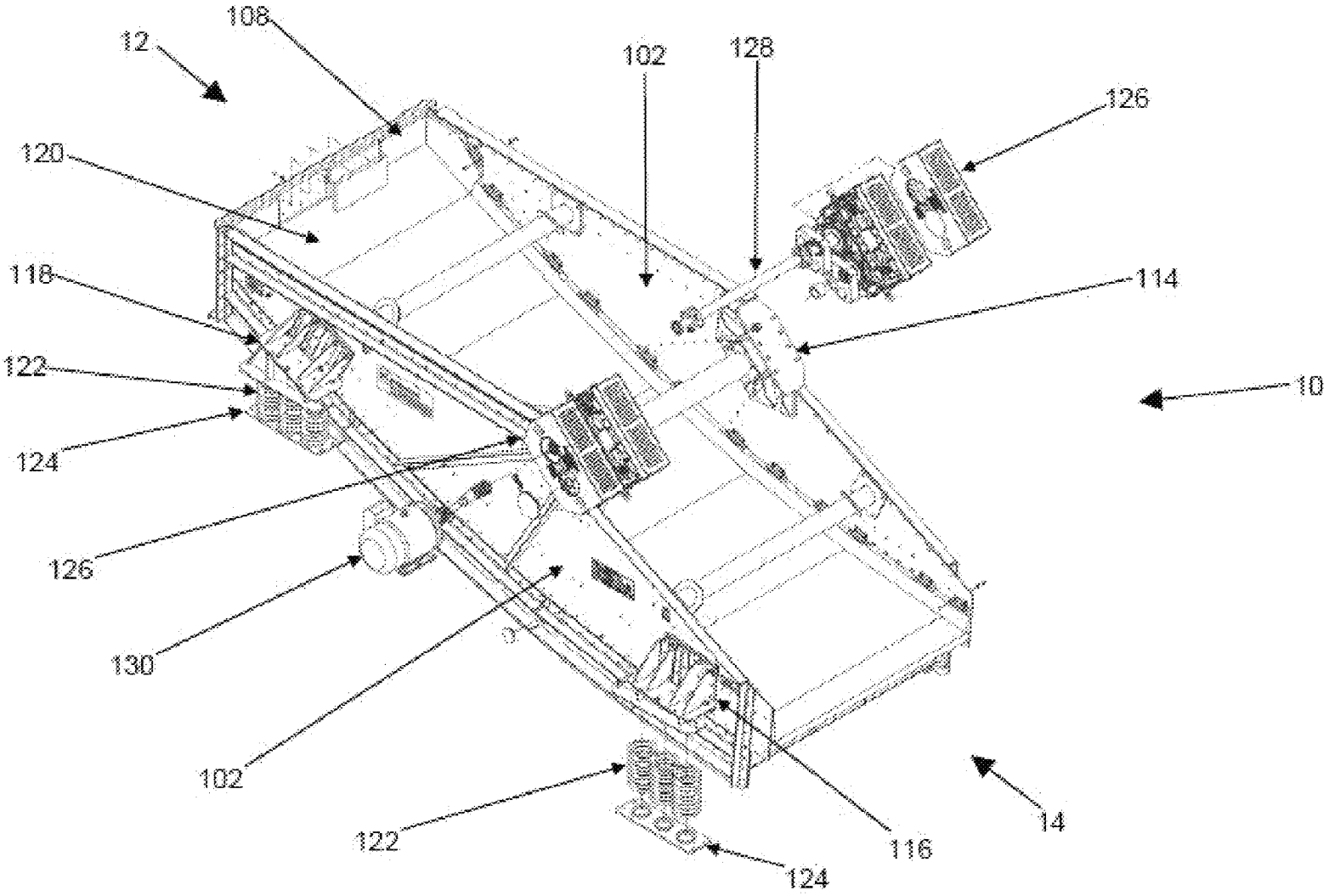
FIG. 2 is a perspective exploded view of a vibrating screen according to an embodiment of the invention.

FIG. 2 illustrates the vibrating screen 10 with screen panels 120 releasably mounted to the stringers 106 (not visible in FIG. 2), springs 122 having spring supports 124, and two vibrators in the form of exciters 126 linked together with drive shaft 128. A drive assembly in the form of an electric motor 130 is provided that provides rotational force to the exciters 126.

The screen panels 120 typically have an arrangement of apertures (not shown) which allow smaller particles of material to pass. At least some of the screen panels 120 at the rear end 12 of the vibrating screen 10 are blind, with no apertures, and made or coated with a wear resistant material. The springs 122 are helical coil springs which engage with annular receiving portions of the spring supports 124. The springs 122 are located between the spring supports 124 and a lower surface of the spring mounts 116 and 118. The exciters 126 are each affixed to a mounting plate 114 which is in turn affixed to the side walls 102. The electric motor 130 is mechanically connected to the exciters 126 and provides the necessary power for the exciters to vibrate.

Figure 3:
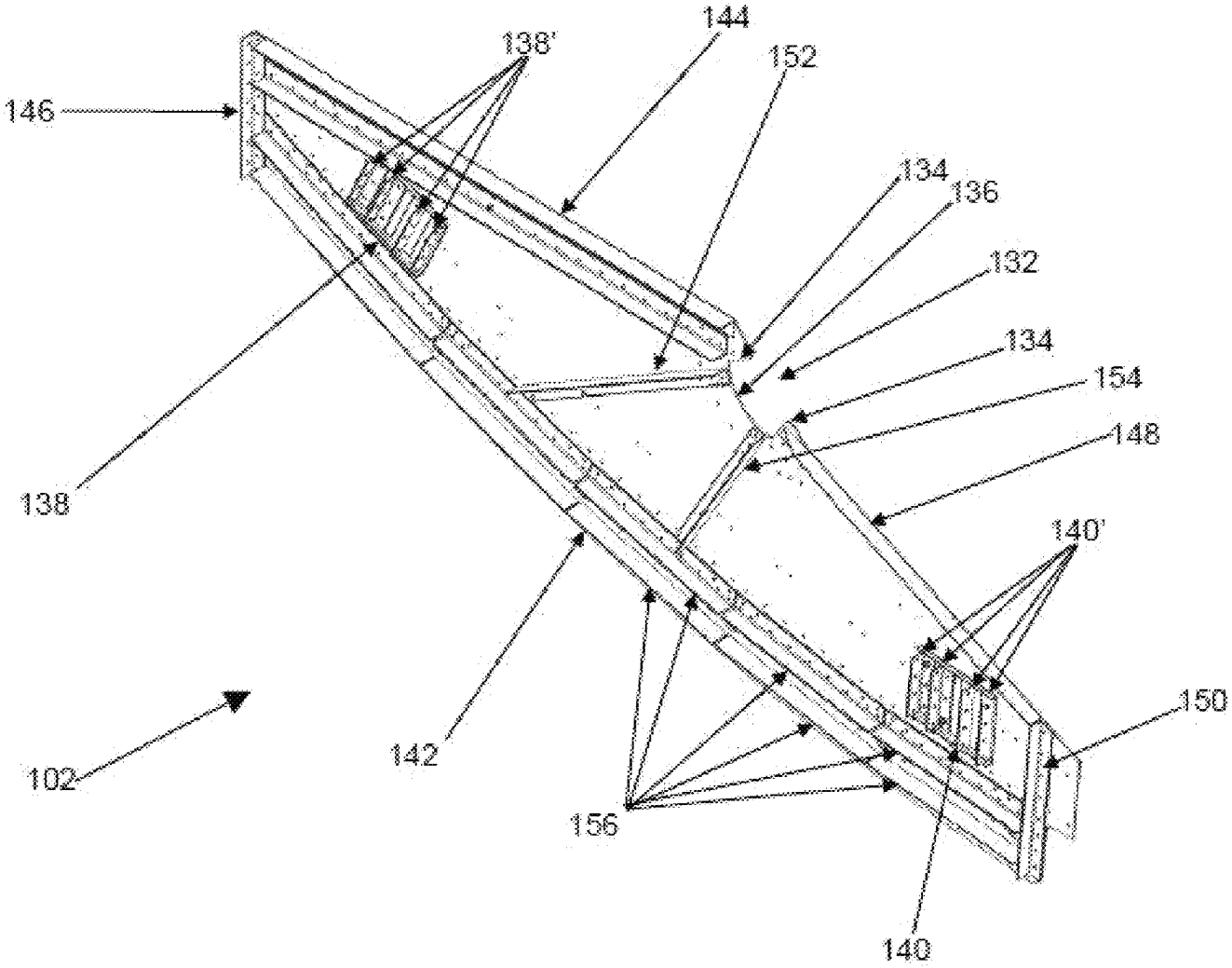
FIG. 3 is a perspective view of a side wall portion of a chassis according to an embodiment of the invention.

FIG. 3 illustrates one of the side walls 102 in isolation. As seen more clearly in FIG. 3, side wall 102 has a recess 132 with tapered sides 134. The tapered sides 134 taper inwards toward the opening of the recess 132 creating a generally scalloped triangular shaped recess 132. An end portion 136 of the recess is curved.

The side wall 102 also has a rear spring mounting region 138 and a front spring mounting region 140. The spring mounting regions 138 and 140 are arranged at different angles such that the rear spring mounting region 138 is inclined relative to the front spring mounting region 140. Each spring mounting region 138 and 140 has a plurality of parallel spring mount projections 138' and 140' that extend perpendicularly outward from the side wall 102 and perpendicularly upward from a bottom edge 142 of the side wall 102 adjacent the respective spring mounting region 138 or 140.

The side wall 102 further has a plurality of reinforcing members including four which extend radially from the recess 132: (A) An upper rear reinforcing member 144 extends along an upper edge of the side wall 102 between the recess and a rear edge 146 of the side wall 102, (B) an upper front reinforcing member 148 extends along an upper edge of the side wall 102 between the recess and a front edge 150 of the side wall 102, (C) a first side reinforcing member 152 extends along the side wall 102 substantially parallel to one of tapered sides 134 of the recess 132; and (D) a second side reinforcing member 154 extends along the side wall 102 substantially parallel to the other of the tapered sides 134 of the recess 132. Several lower reinforcing members 156 are also provided along and adjacent to the bottom edge 142 of the side wall 102. The lower reinforcing members 156 are arranged substantially parallel to the bottom edge 142.

Figure 5:
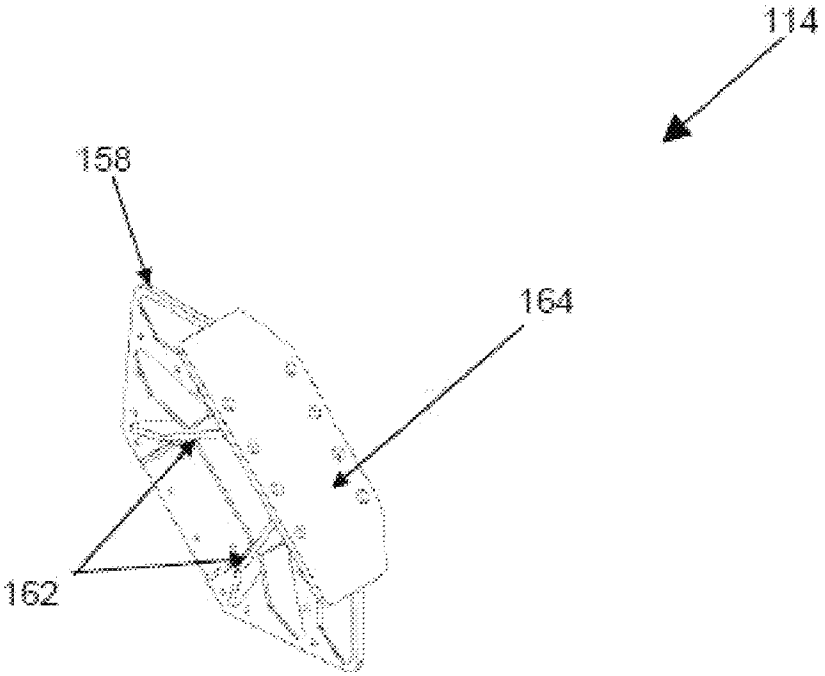
FIG. 5 is a rear perspective view of a mounting plate according to an embodiment of the invention.
Figure 4:
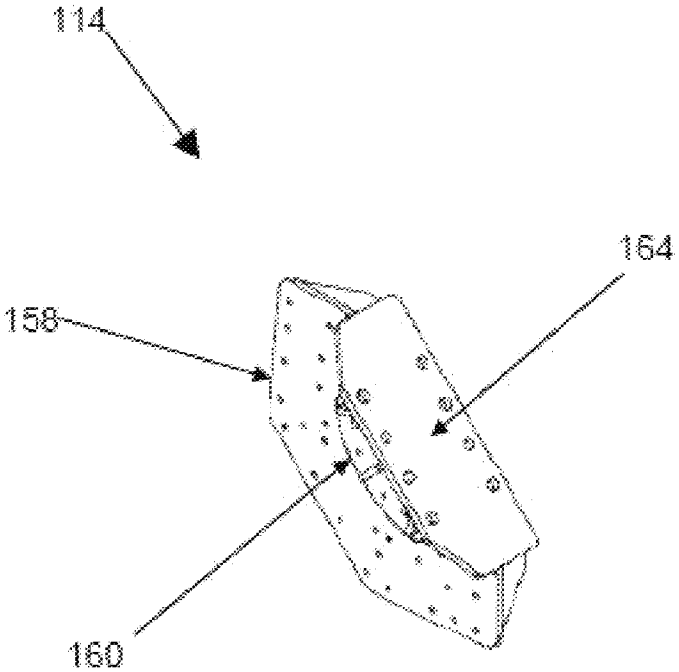
FIG. 4 is a front perspective view of a mounting plate according to an embodiment of the invention.

FIGS. 4 and 5 illustrate a mounting plate 114 which has a substantially planar skirt 158 extending from a protrusion 160 on one side (see FIG. 4) and with a plurality of reinforcing ribs 162 on the other side (see FIG. 5). The mounting plate 114 has a substantially planar vibrator mounting portion 164 that, as illustrated in FIG. 2, supports and provides a mount for the exciters 126.

Figure 6:
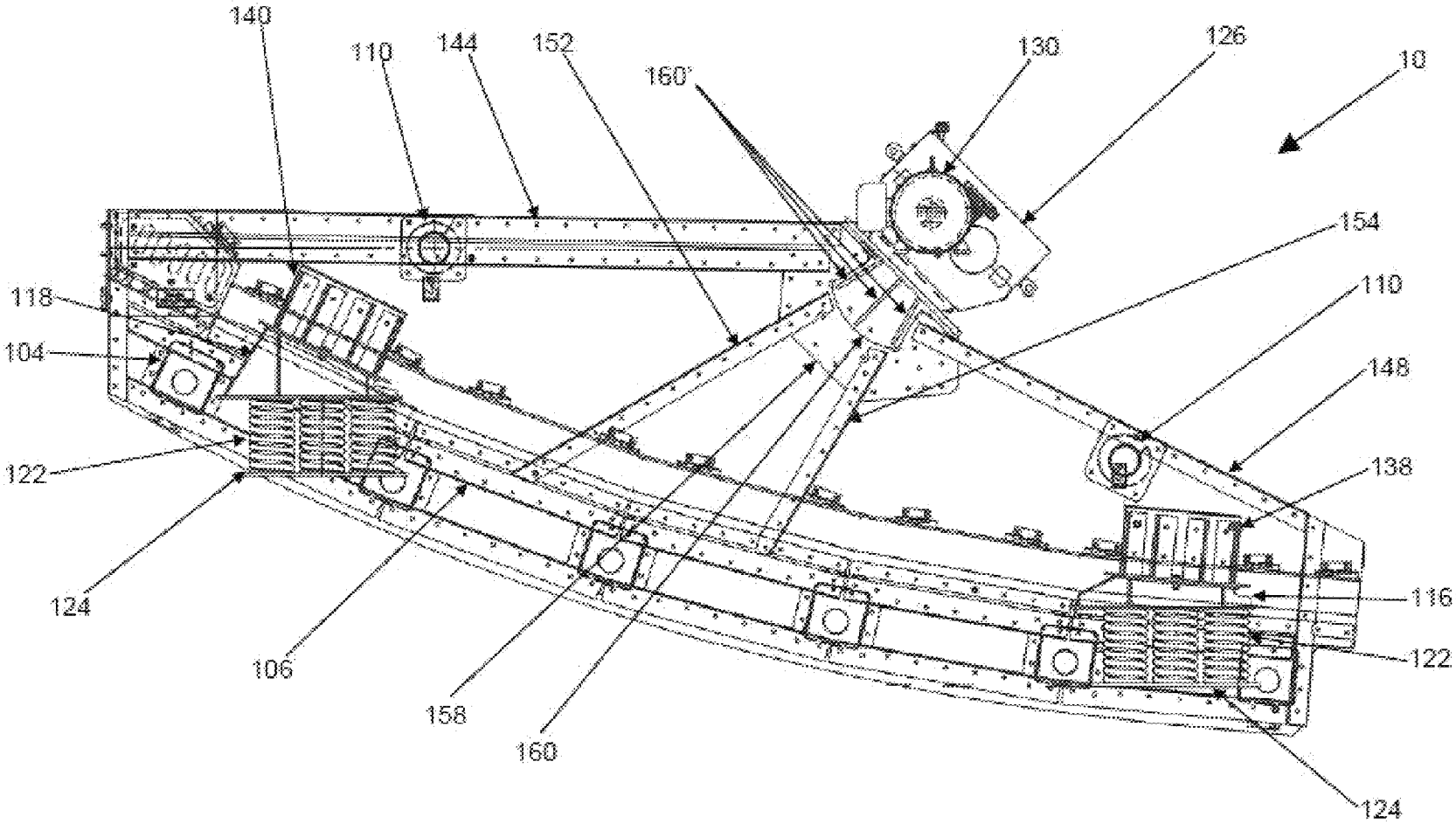
FIG. 6 is a partially transparent side elevation view of a vibrating screen according to an embodiment of the invention.

As seen more clearly in FIG. 6, the protrusion 160 of the mounting plate 114 corresponds to the recess 132 of the side wall 102 such that they interlock. Protrusion 160 has three protrusion reinforcing members 160' that extend substantially radially with respect to the curved end of the protrusion 160. The outer two reinforcing members 160' and a portion of the reinforcing ribs 162 on the other side of the mounting plate 114 are substantially aligned with first and second side reinforcing members 152, 154.

The skirt 158 of the mounting plate 114 is also visible in FIG. 6 and can be seen extending around the protrusion 160 to overlap proximal ends of reinforcing members 144, 148, 152, and 154. This provides structural reinforcement between the mounting plate 114, and therefore exciters 126 mounted thereon, and the side walls 102, including reinforcing members 144, 148, 152, and 154, of the vibrating screen 10.

Also clearly seen in FIG. 6 is that the springs 122 are biased substantially perpendicularly to the spring mounts 116, 118; with the front spring mounts 116 being mounted at a slight angle of approximately 5° to the horizontal and with the rear spring mounts 118 being mounted at a greater angle of approximately 25° to the horizontal. The mounting angle of the front and rear spring mounts 116 and 118 is substantially the same as the angle of the screen panels 120 located between respective front and rear pairs of spring mounts 116 and 118 of each side wall 102.

Figure 8:
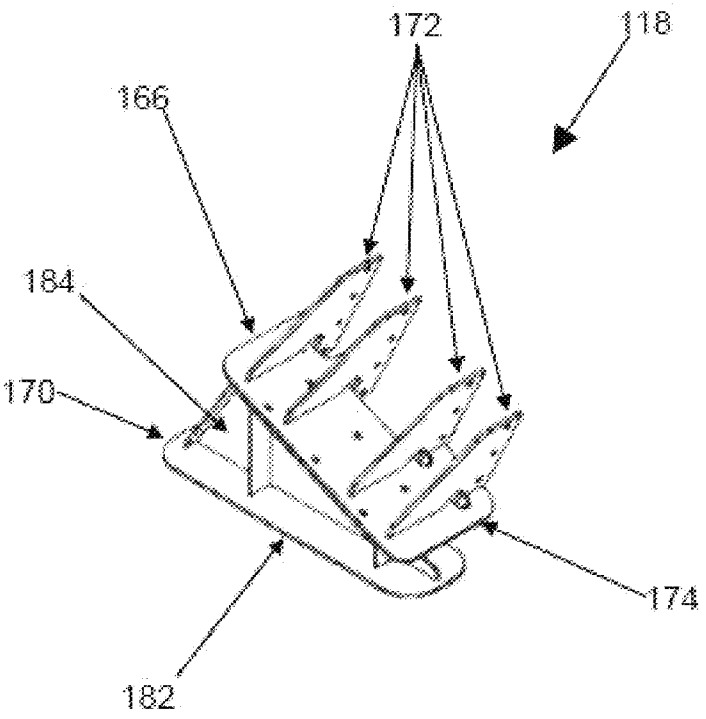
FIG. 8 is a perspective view of a rear spring mount according to an embodiment of the invention.
Figure 7:
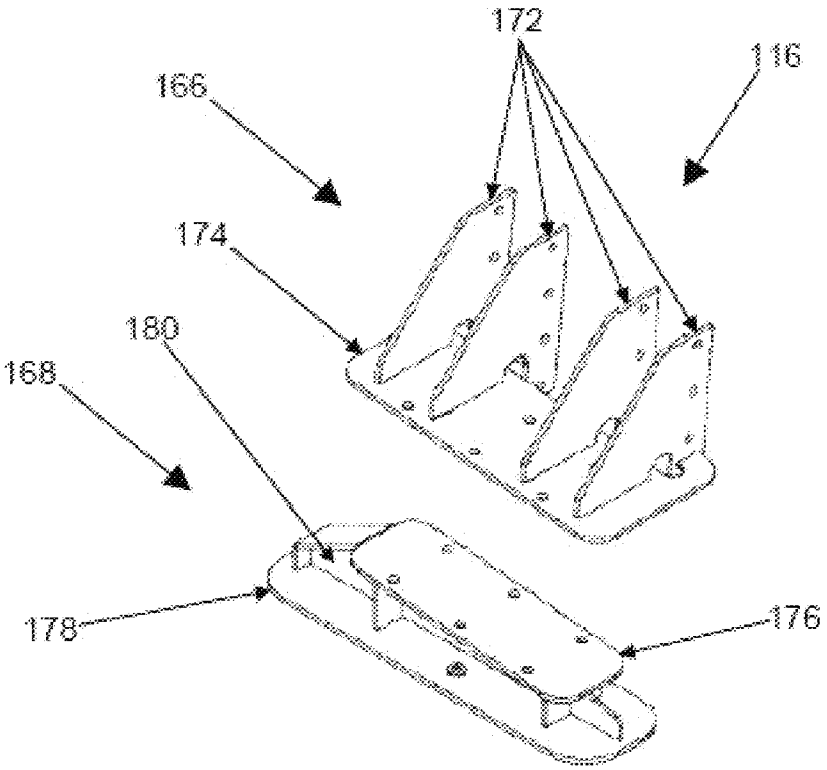
FIG. 7 is an exploded perspective view of a front spring mount according to an embodiment of the invention.

The spring mounts 116 and 118 are more clearly illustrated in FIGS. 7 and 8, with FIG. 7 illustrating an exploded view of a front spring mount 116 and with FIG. 8 illustrating a non-exploded view of a rear spring mount 118. The front spring mount 116, illustrated in FIG. 7, has a foot 166 and a front wedge 168; and the rear spring mount 118 has a foot 166, which is the same as the foot 166 for the front spring mount 116, and a rear wedge 170.

The feet 166 each have a plurality of parallel fins 172 that extend perpendicularly from a base portion 174 of the feet 166. The fins 172 correspond to the plurality of parallel spring mount projections 138' and 140' of the spring mounting regions 138 and 140 of the side wall 102 and enable the feet 166 to be rigidly affixed to the spring mounting regions 138 and 140. The base portion 174 of each foot 166 is substantially planar and is affixed to one of the wedges 168 and 170.

The front wedge 168 illustrated in FIG. 7 has an upper surface 176 and a lower surface 178 separated by web 180. The upper surface 176 is inclined relative to the lower surface 178, by an angle of approximately 5°. The rear wedge 170 illustrated in FIG. 8 has an upper surface, obstructed from view in FIG. 8 by base 174 of foot 166, and a lower surface 182 separated by web 184. The upper surface of rear wedge 170 is inclined relative to the lower surface 182, by an angle of approximately 25°. The different shaped wedges 168 and 170 allow the feet 166 for the front spring mount 116 and the rear spring mount 118 to be identical, while providing a spring mount 116 and 118 that enables the springs 122 to be arranged substantially horizontally with respect to one another and the front and rear spring mounting regions 138 and 140 to be inclined relative to the springs 122.

In use, the vibrating screen 10 of the present invention receives material to be separated, typically an ore, in the inlet end 12 which has wear resistant blind panels 120. The exciters 126 generate vibratory forces which are transferred to the chassis 100 via the vibrator mounting plates 114 which in turn transfer the vibratory forces to the side walls 102, including through the three protrusion reinforcing members 160' and reinforcing ribs 162 of the mounting plates 114 that substantially align with reinforcing members 144, 148, 152, and 154 of the side walls 102, which are also affixed through the skirt portion 158 of the mounting plates 114.

As the chassis 100 vibrates the screen panels 120, mounted on the stringers 106, also vibrate which, in turn, vibrates the material being separated. As the inlet end 12 of the vibrating screen 10 is inclined relative to the outlet end 14, the material traverses the screen panels 120 and is separated as smaller particles pass through apertures in the screen panels 120 and larger particles stay above the screen panels 120.

Advantageously the vibrating screen 10 provides efficient transfer of vibratory forces from the exciters 126 to the chassis 100 through the vibrator mounting plates 114 which have a protrusion 160 that engages with a correspondence recess of the side walls 102 of the chassis 100 in all axes along a plane defined by the side walls 102.

Additionally, the reinforcement arrangement including the skirt 158, with protrusion 160, three protrusion reinforcing members 160', and reinforcing ribs 162, of the vibrator mounting plates 114 being affixed to the reinforcing members 144, 148, 152, and 154 reduces the overall reinforcement required. For example, the efficient energy transfer and unique reinforcement arrangement result in the vibrator reinforcing beam 112 being lighter in weight than similar beams in previous vibrating screens. The quantity of materials required to produce the vibrating screen 10 are therefore reduced. This not only reduces manufacturing costs, but also reduces weight and improves operation efficiency.

Duplication of various parts also further reduces costs, such as the vibrator mounting plates 114 being the same and the feet 166 of the spring mounts 116 and 118 being the same. This further reduces manufacturing costs and also reduces the number of different spare parts required to replace such components.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In the present specification and claims (if any), the word "comprising" and its derivatives including "comprises" and "comprise" include each of the stated integers but does not exclude the inclusion of one or more further integers unless the context of use indicates otherwise.

The invention claimed is:

1. A vibrating screen comprising:

a chassis including two side walls with a plurality of support members therebetween and a screen mounting system that receives screen panels; and at least one vibrator that generates vibrations; the at least one vibrator being attached to a mounting plate having at least one reinforcing rib and at least one protrusion;

wherein at least one side wall has a recess;

wherein the recess is configured to receive the protrusion of the mounting plate in a substantially interlocking manner;

wherein the mounting plate further comprises a substantially planar skirt that extends from at least a portion of the protrusion, with the skirt being attached to at least one side wall;

wherein the at least one reinforcing rib extends along at least a portion of the skirt; and wherein the protrusion is on one side of the mounting plate and the at least one reinforcing rib is on the other side of the mounting plate.

2. A vibrating screen comprising:

a chassis including two side walls with a plurality of support members therebetween and a screen mounting system that receives screen panels; and at least one vibrator that generates vibrations; the at least one vibrator being attached to a mounting plate having at least one reinforcing rib and at least one protrusion;

wherein at least one side wall has a recess;

wherein the recess is configured to receive the protrusion of the mounting plate in a substantially interlocking manner;

wherein the side walls have a plurality of side reinforcing members that extend along the side wall away from the recess; and wherein the mounting plate is affixed to the side walls and at least one side reinforcing member.

3. A vibrating screen comprising:

a chassis including two side walls with a plurality of support members therebetween and a screen mounting system that receives screen panels; and at least one vibrator that generates vibrations; the at least one vibrator being attached to a mounting plate having at least one reinforcing rib and at least one protrusion;

wherein at least one side wall has a recess;

wherein the recess is configured to receive the protrusion of the mounting plate in a substantially interlocking manner;

wherein the side walls have a plurality of side reinforcing members that extend along the side wall away from the recess; and wherein at least one of the side reinforcing members is affixed to the at least one reinforcing rib.

* * * * *